US007527152B2

(12) United States Patent
Lentner et al.

(10) Patent No.: US 7,527,152 B2
(45) Date of Patent: May 5, 2009

(54) TRAY AND BUNDLE PACK

(75) Inventors: Laura Lee Lentner, Appleton, WI (US); Joshua Hilton Thyren, Appleton, WI (US); Charlcie C. K. Leitner, Appleton, WI (US); Richard Frederick House, Geneva, IL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 565 days.

(21) Appl. No.: 11/245,793

(22) Filed: Oct. 7, 2005

(65) Prior Publication Data

US 2007/0080087 A1 Apr. 12, 2007

(51) Int. Cl.
*B65D 65/00* (2006.01)

(52) U.S. Cl. ..... 206/497; 206/391; 206/426

(58) Field of Classification Search ..... 206/497, 206/391, 427, 422, 526, 432, 557, 494, 233; 229/108, 110, 191; 220/23.83
See application file for complete search history.

(56) References Cited

U.S. PATENT DOCUMENTS

| | | | | |
|---|---|---|---|---|
| 1,981,731 | A | 11/1934 | Holy | |
| 2,103,241 | A | 12/1937 | John | |
| 2,217,953 | A | 10/1940 | Igou | |
| 2,990,056 | A | 6/1961 | Gillam | |
| 3,054,682 | A * | 9/1962 | Russell et al. | 426/129 |
| 3,302,843 | A * | 2/1967 | Sheehan | 229/108 |
| 3,768,639 | A | 10/1973 | Dogliotti | |
| 3,817,373 | A * | 6/1974 | Samsing | 206/432 |
| 3,841,476 | A * | 10/1974 | Elford | 206/427 |
| 3,991,880 | A | 11/1976 | Austrins et al. | |
| 4,062,448 | A * | 12/1977 | Meighan | 206/432 |
| 4,483,455 | A * | 11/1984 | Prophet et al. | 220/23.83 |
| 5,180,052 | A | 1/1993 | Smith et al. | |
| 5,535,940 | A | 7/1996 | Olds | |
| 5,555,982 | A * | 9/1996 | Kuhn et al. | 206/746 |
| 5,624,031 | A * | 4/1997 | Fowler et al. | 206/391 |
| 5,927,494 | A * | 7/1999 | Fowler et al. | 206/391 |
| 6,978,892 | B2 * | 12/2005 | Bansal et al. | 206/497 |
| 2003/0155266 | A1 * | 8/2003 | Andersen et al. | 206/497 |

FOREIGN PATENT DOCUMENTS

| | | |
|---|---|---|
| FR | 2 795 388 A1 | 12/2000 |

* cited by examiner

*Primary Examiner*—David T Fidei
(74) *Attorney, Agent, or Firm*—Gregory E. Croft

(57) ABSTRACT

A bundle pack includes a tray having a bottom, a sidewall, and a tray longitudinal axis. A plurality of packaged products disposed in the tray and the packaged products each having a product longitudinal axis and a product transverse axis. The plurality of packaged products is each disposed at an angle in the tray such that each product longitudinal axis forms a product angle $\alpha$ with the tray longitudinal axis.

10 Claims, 8 Drawing Sheets

42
44
44
28
50
52
52
62
62
62
62
62
62
62
62
62
62
62
62
62
62
32
32
32
32
32
32
64
64
64
64
64
64
66
66
66
66
66
66
68
68
70
70
46
48
48
48

TRAY AND BUNDLE PACK

BACKGROUND

In the packaging of consumer products, such as facial tissue dispensers, it is often desirable to bundle or package several packaged products together to form a bundle pack. The bundle pack is often used to provide an assortment of packaged products in one convenient larger package or bundle. One method of making a bundle pack is to place the packaged products in a tray and then shrink wrap or otherwise secure the individual packaged products in the tray.

Frequently the tray's design is mainly concerned with minimizing the tray's footprint or area. This objective saves on the costs to produce the tray, and saves shipping costs for the bundle pack by packing the individual packages into the minimum amount of space possible. Making the tray smaller also reduces the shelf space needed to stock the item at a retailer. While this may be desirable for some packaged products and bundle packs, it can be a problem for packaged products having attractive graphics, for packaged products having fancy designs, or for packaged products having unique shapes.

For "high end" or more expensively packaged products, purchase intent by a consumer is often driven by the attractiveness of the individual package itself and not as much by the product within the attractive package. Often these higher end packaged products are seasonal, collectable, or limited production runs. In such cases, it is important that the consumer can observe a significant portion of the individual packaged product within the bundle pack; especially, if more than one type of design or graphic is placed onto each package within the bundle pack. That way, a consumer can see if the bundle pack contains the assortment of designs they prefer most.

Thus, what is needed is a tray or bundle pack that allows for a significant portion of each individual packaged product within the bundle to be observed. Also what is needed is a tray or bundle pack that minimizes the amount of space utilized by the bundle pack to save on shipping costs and manufacturing costs.

SUMMARY

The inventors have determined that the above needs can be met by a tray holding a plurality of packaged products with the products aligned at an angle to the central longitudinal axis of the tray. With the packaged products rotated at an angle within the tray, a significant portion of the individual packaged product's graphics can be observed while still minimizing the overall size of the bundle pack and tray. This allows for a consumer to readily observe more of the front faces of the individual packaged products, but the tray and bundle pack still takes up less space than if the individual packaged products' longitudinal axes were positioned completely rotated and parallel to the front and back sides of the tray.

Hence, in one aspect, the invention resides in a bundle pack including: a tray having a bottom, a sidewall, and a tray longitudinal axis; a plurality of packaged products disposed in the tray, the packaged products each having a product longitudinal axis and a product transverse axis; and wherein the plurality of packaged products are each disposed at an angle in the tray such that each product longitudinal axis forms a product angle $\alpha$ with the tray longitudinal axis. In another aspect the invention resides in a tray including a bottom and a sidewall, and wherein the bottom is substantially rectangular in shape and has at least one angled corner.

BRIEF DESCRIPTION OF THE DRAWINGS

The above aspects and other features, aspects, and advantages of the present invention will become better understood with regard to the following description, appended claims, and accompanying drawings where:

Figure 1:
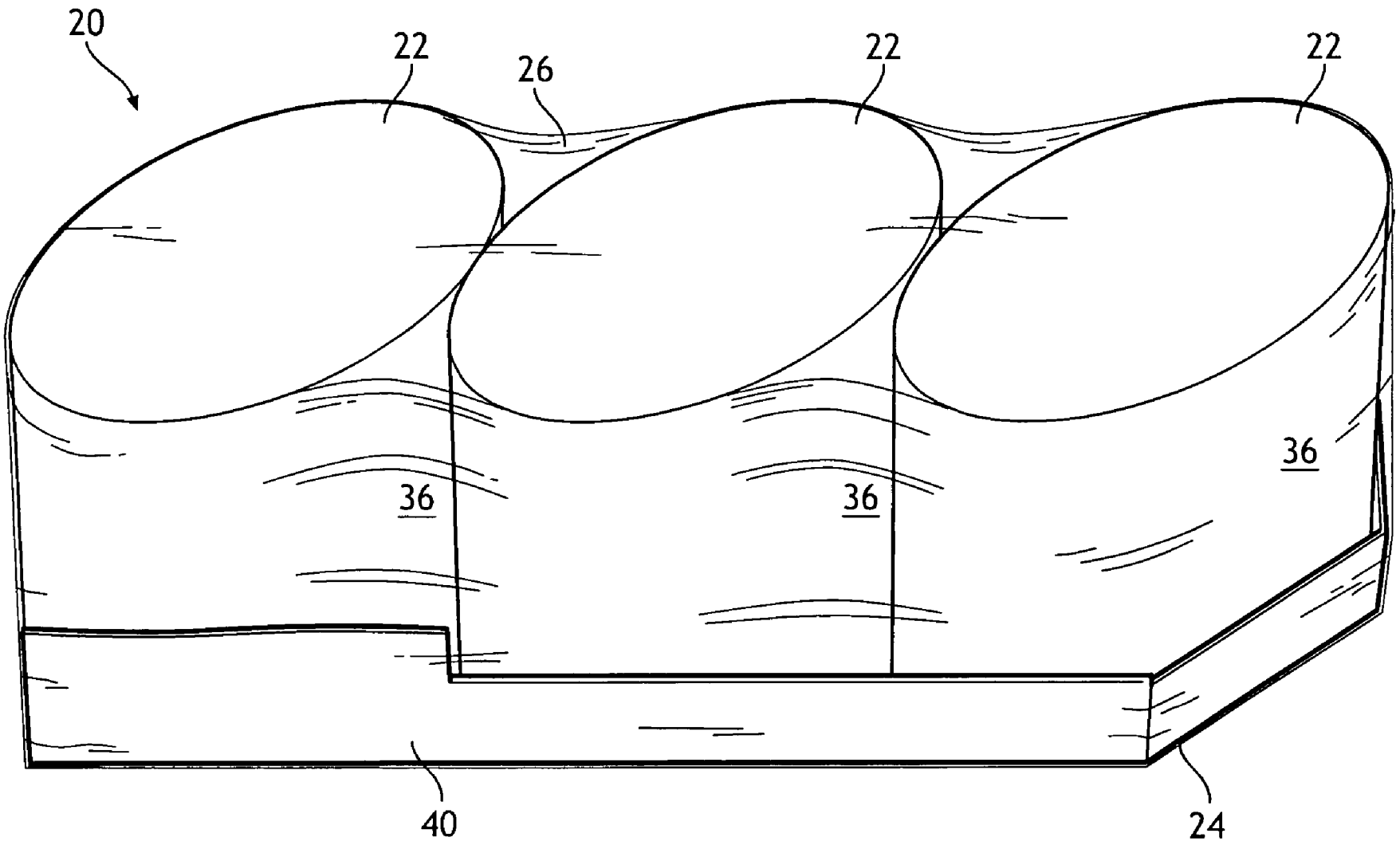
FIG. 1 illustrates a prospective view of a bundle pack with the packaged products dispensers disposed in a tray.
Figure 2:
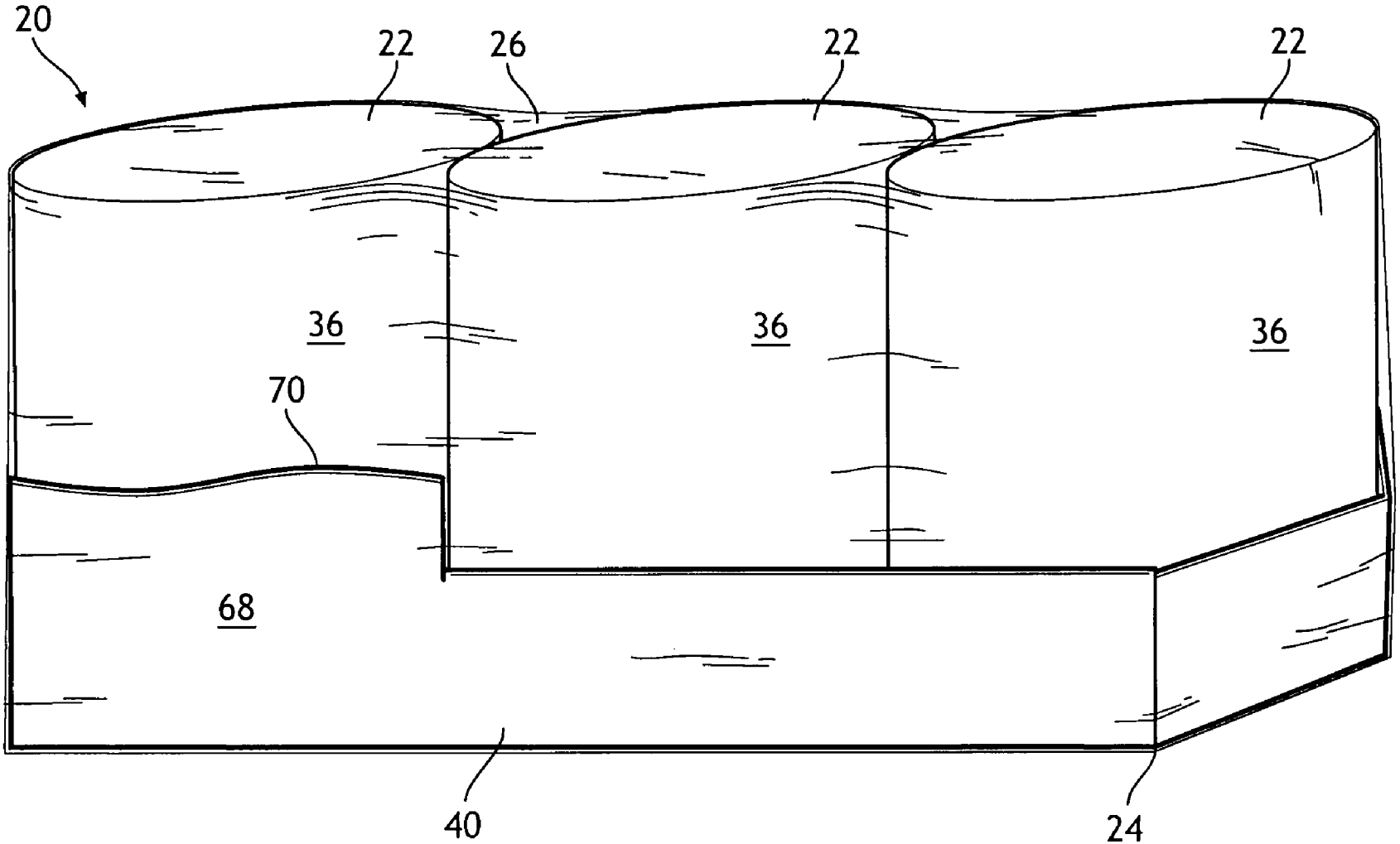
FIG. 2 illustrates a front view of the bundle pack of FIG. 1.

Repeated use of reference characters in the specification and drawings is intended to represent the same or analogous features or elements of the invention.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 3:
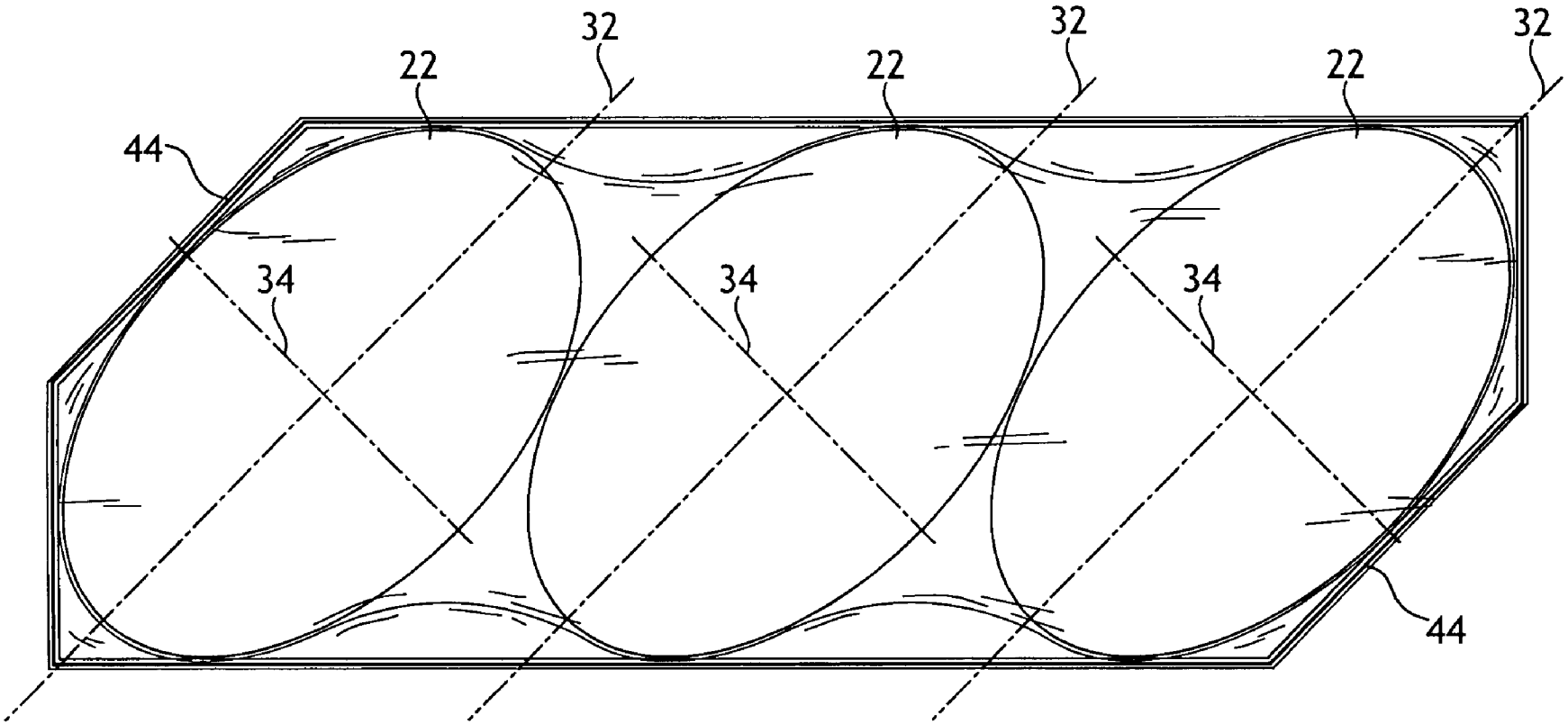
FIG. 3 illustrates a top view of the bundle pack of FIG. 1.
Figure 4:
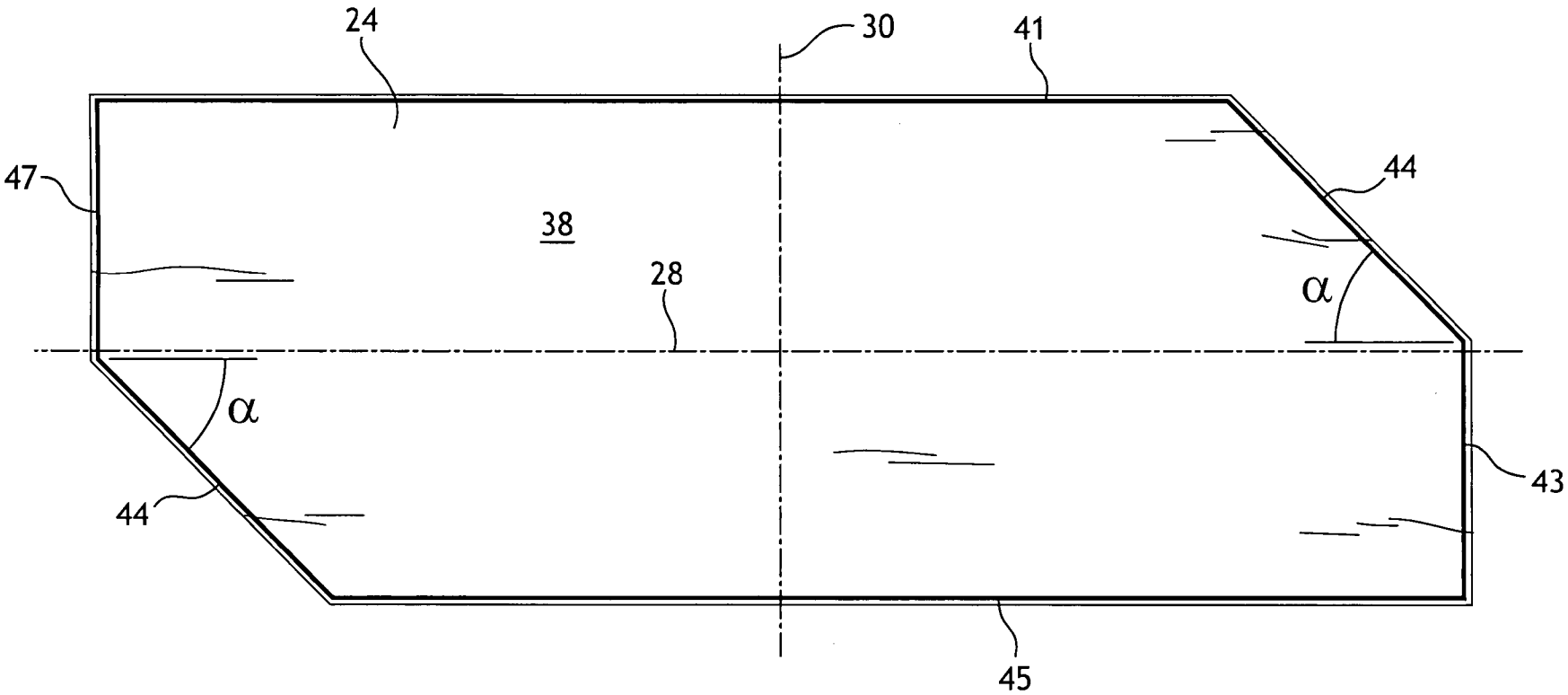
FIG. 4 illustrates a bottom view of the bundle pack of FIG. 1.
Figure 5:
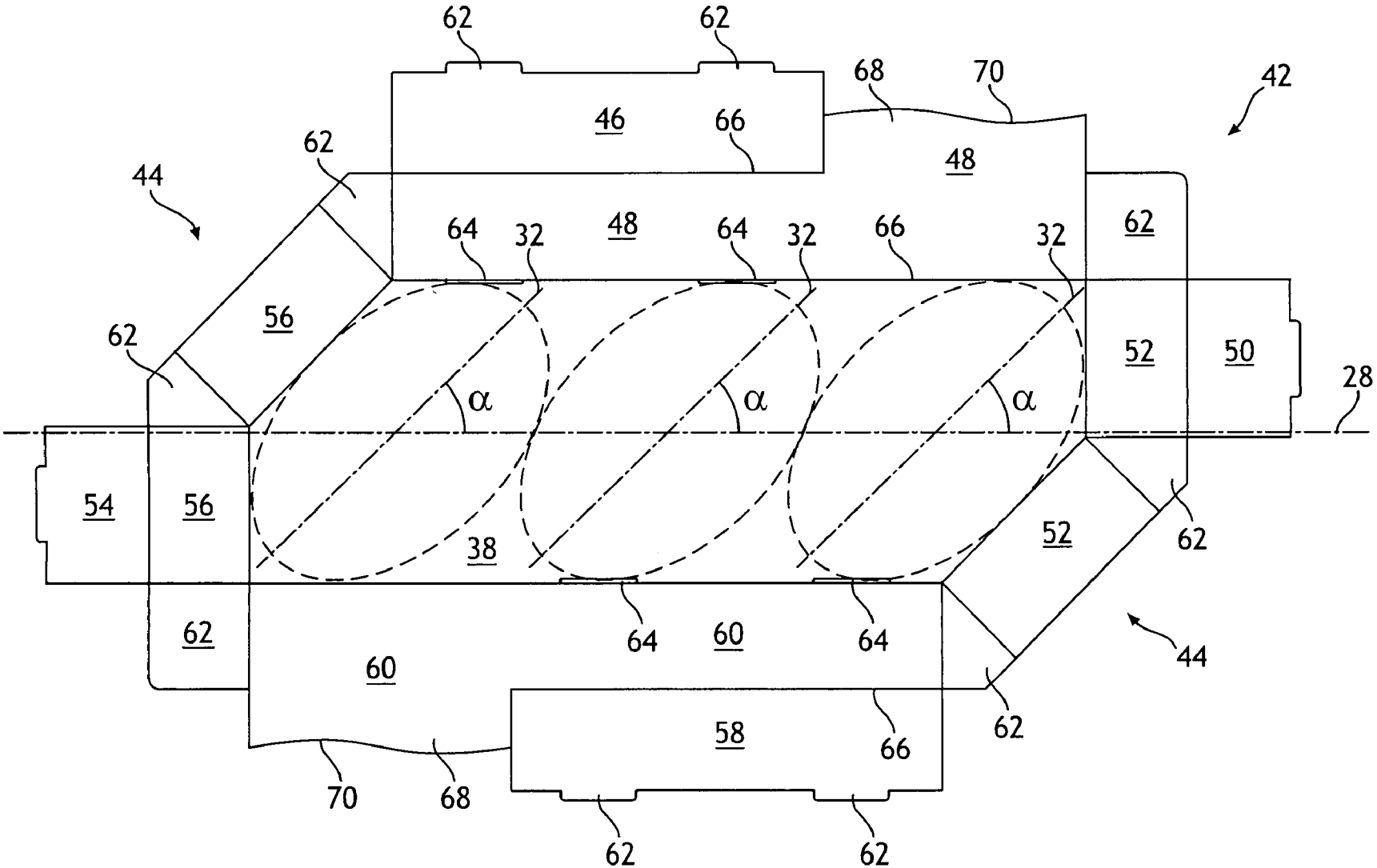
FIG. 5 illustrates a blank that can be folded into a tray for housing a plurality of packages.

Referring now to FIGS. 1-5, a bundle pack 20 including a plurality of packaged products 22, such as facial tissue dispensers, is shown. The bundle pack 20 includes a tray 24 and may include a shrink wrap 26 to contain the packaged products 22 within the tray 24. As seen in FIG. 4, the tray 24 has a tray longitudinal axis 28 and a tray transverse axis 30. As seen in FIG. 3, each packaged product within the tray has a product longitudinal axis 32 and a product transverse axis 34. As seen in FIGS. 3 and 5, the packaged products 22 are disposed within the tray 24 such that the product longitudinal axis 32 is rotated at a product angle $\alpha$ to the tray longitudinal axis 28.

The product angle $\alpha$ is adjusted to compromise between showing more of each product's front face 36 to better display the product's graphics and between making the overall length of the bundle pack 20 smaller. In general, as the product angle $\alpha$ becomes larger, the bundle pack's length decreases while at the same time less of each product's front face 36 would be seen from the perspective in FIG. 2. If the product angle $\alpha$ is equal to 90 degrees, most of the middle packaged product 22 would be obscured by the outer two packaged products; however, the tray's length along the tray longitudinal axis 28 would be its smallest. Conversely, as the product angle $\alpha$ becomes smaller, more of the product's front face 36 is visible, but the overall length of the bundle pack increases significantly. If the product angle $\alpha$ is equal to 0 degrees, the full front face 36 of each packaged product 22 would be visible, but the tray 24 would be its largest length. To best trade off visibility of each product's front face 36 while minimizing the tray's size, in the various embodiments, the product angle $\alpha$ can be between about 10 degrees to about 80 degrees, or between about 30 degrees to about 60 degrees, or between about 40 degrees to about 50 degrees.

The tray 24 can be used to house any number of packaged products 22, and the packaged products can have many different shapes. For example, the packaged product 22, and in particular the product's sidewall, could be square, rectangular, oval, race track having a flat front and flat back with circular ends, or other shape. In general, the angular rotation of the products within the tray is best suited for products having a longer dimension along the product longitudinal axis 32 and a shorter dimension along the product transverse axis 34. However, it may be desirable to rotate products with a square sidewall in order to display two separate faces of the product.

The packaged products 22 within the tray can be arranged in an overlapped manner along the tray longitudinal axis 28 such that the front face 36 of one packaged product is partially obscured by the back face of the next packaged product as shown in FIG. 1. Alternatively, the packaged products can be arranged along the tray longitudinal axis 28 in a point-to-point manner such that the corner, side, or edge of one packaged product abuts the corner, side, or edge of the next packaged product. Such an arrangement may be desirable for packaged products having a square side wall, such as an upright facial tissue dispenser, in order to enable all four faces on the sidewall of each dispenser to be observed.

The number of packaged products 22 within the tray can vary depending on the individual size of the packaged products 22 housed by the tray 24, and the desired overall size of the tray. In general, the number of packaged products 22 within the tray can be between 2 to about 20, or between 2 to about 10, or between 2 to about 5. Depending on the individual size of the packaged products 22, they can be housed within the tray in a single row or multiple rows. In general, it is preferred to have a single row of the packaged products 22 so as to be able to observe both a portion of the product's front face 36 and back face through the shrink wrap 26. In other embodiments, especially for smaller packaged products, the packaged products can be arranged in two, three, four, or even five rows along the tray's longitudinal axis 28.

The packaged products 22 within the tray may be stacked one on top of another by suitable methods such as interlocking tops and bottoms on the packaged products, by using a stacking layer such as a piece of cardboard between the rows of the packaged products, or by rotating the second and alternating rows of packaged products in the opposite direction of the row beneath. The packaged products can be stacked in two, three, or more rows on the tray's bottom depending on the individual size of the packaged product. Alternatively, two, three, or more trays having a single height of the packaged products can be stacked, and then the entire grouping of the stacked multiple trays containing the packaged products shrink wrapped or otherwise secured together to form the bundle pack 20.

The packaged products 22 housed by the tray 24 can be any number of consumer products frequently sold by mass merchandisers, grocery stores, discount stores, and the like. Especially preferred products are packages or dispensers containing single or limited use disposable products. Such products could be dispensers housing wet wipes, facial tissue, paper towels, paper napkins, and other sheet substrates. Other disposable products such as gloves, face masks, facial cleaning pads, tampons, incontinence pads, and sanitary napkins may be placed into the individual product dispensers 22. Discrete dispensers for tampons, incontinence pads, and sanitary napkins that are both attractive and discrete, such that they can be left in plain view on counters or other surfaces, are becoming especially important.

The bundle pack can hold combinations of different packaged products such as a wet wipes dispenser and a napkin or towel dispenser. The bundle pack can combine different sizes of the same packaged product such as a travel or mini-size product and a regular or family size product. In one embodiment, the packaged product 22 was a facial tissue dispenser having an oval sidewall and housing a plurality of facial tissue sheets. The dispenser measured approximately 6 inches along the product longitudinal axis, 4 inches along the product transverse axis, and was approximately 5¾ inches in height. Other shaped dispensers or product packages for facial tissues can be disposed within the tray 24.

The tray 24 includes a bottom 38 and a sidewall 40. The tray can be injection molded, thermo-formed, or assembled from a blank 42 (FIG. 5) into the tray 24. The tray can be formed of a suitable low cost disposable material such as paper, board, cardboard, or plastic. Alternatively, the tray can be formed of a more durable material such as wood, metal, thicker plastic and the like.

Suitable dimensions for the tray and the sidewall height can vary depending on the sizes of the packaged products and the number contained by the tray. In general, the tray will have a longer length along the tray longitudinal axis 28 than width along the tray transverse axis 28. Suitable dimensions for the length can be between about 5 inches to about 30 inches, or between about 9 inches to about 15 inches. Suitable dimensions for the width can be between about 3 inches to about 15 inches, or between about 4 inches to about 7 inches. In general, the sidewall of the tray should be shallower to allow more of each front face 36 to be visible while still retaining the packaged products 22 within the tray. Suitable dimensions for the sidewall height can be between about 0.5 inch to about 4 inches, or between about 1 inch to about 2 inches.

The tray can be designed to hold the packaged products 22 at the product angle $\alpha$ to the tray longitudinal axis 28. For example, the bottom 38 of the tray 24 could be formed, with recesses at the appropriate product angle $\alpha$ to hold the packaged products. Alternatively, the tray could have a top or an upper layer spaced apart from the bottom 38 with apertures or cutouts to hold the packaged products at the appropriate product angle $\alpha$. In the illustrated embodiment, the tray 24 has a substantially rectangular bottom 38 that has at least one corner 44 that is angled for aligning the packaged products at a corner angle $\alpha$ to the tray longitudinal axis (FIG. 4).

In a preferred embodiment, the tray has a substantially rectangular bottom having two opposing corners 44 that are angled for aligning the packaged products at the same corner angle $\alpha$. The corner angle $\alpha$ can be the same ranges as for the product angle $\alpha$ previously described. The tray can be angled on the corner where the front sidewall 41 meets the right sidewall 43, and on the opposite corner where the back sidewall 45 meets the left sidewall 47. Rather than just angle the corner(s) 44, it is possible to angle the entire right and left sidewalls (43, 47) of the tray such that the bottom of the tray is a parallelogram.

Referring now to FIG. 5, a blank 42 is shown that can be folded into the tray 24. Also, for reference the oval outline of the packaged products 22 is shown in dashed lines on the bottom 38. The blank includes a bottom 38, a back inside sidewall 46, a back outside sidewall 48, a right inside sidewall 50, a right outside sidewall 52, a left inside sidewall 54, a left outside sidewall 56, a front inside sidewall 58, and a front outside sidewall 60. The blank 42 also includes a plurality of tabs 62 for either inserting between the inside and outside sidewalls, or for inserting into a plurality of slots 64 cut into the bottom 38. The blank also has a plurality of crease or fold lines 66. To form the blank 42 into the tray 24, the blank is cut and then folded on the fold lines. The tabs are inserted into their proper position, either between the inside and outside sidewalls, or into the slots to hold the blank into its formed position.

As seen, the tray has a double thickness sidewall along most of the perimeter except for the angled corners 44. By having a single thickness sidewall at the angled corners, the blanks can be nested for efficiency with less waste on single larger piece of board stock. The double sidewall also allows for the tray 24 to be made stronger and more resistant to deformation. If desired, the entire sidewall 40 could be double or even triple thickness, or the sidewall could be a single thickness. Other methods of forming the blank into a tray instead of tabs and slots can be used as known to those of skill in the art.

The sidewall 40 can also include at least one panel 68 that protrudes above the height of the sidewall 40 to add visual interest to the sidewall and to provide a prominent area in which to place a trademark or brand name for the packaged products 22 in the bundle pack 20. The panel can be located along any portion of the sidewall 40, but ordinarily will be located along at least the front sidewall. To further add visual interest, the top edge 70 of the panel 68 can be a curvilinear line and resemble a portion of the trademark printed on panel 68.

If desired, another panel 68 can be located along the back sidewall such that the bundle pack 20 can be placed on the store shelf and viewed from the front or the back, which appear identical. In this manner, the tray 24 and/or the bundle pack 20 can have 180 degree rotational symmetry about the point where the tray longitudinal 28 and the tray transverse 30 axes meet. 180 degree rotational symmetry is exemplified by a deck of cards where each card's face value can be rotated 180 degrees and the design for the card's face value appears identical. 180 degree rotational symmetry provides a customer benefit since it is easier to stock the bundle pack on retail shelves without being concerned with orientating the bundle pack to face only one specific direction. In one specific embodiment, the placement of the packaged products in the tray, the front and back faces of the packaged products, and the placement of the two panels were such that the bundle pack 20 when viewed from either the front or the back had 180 degree rotational symmetry.

Figure 6:
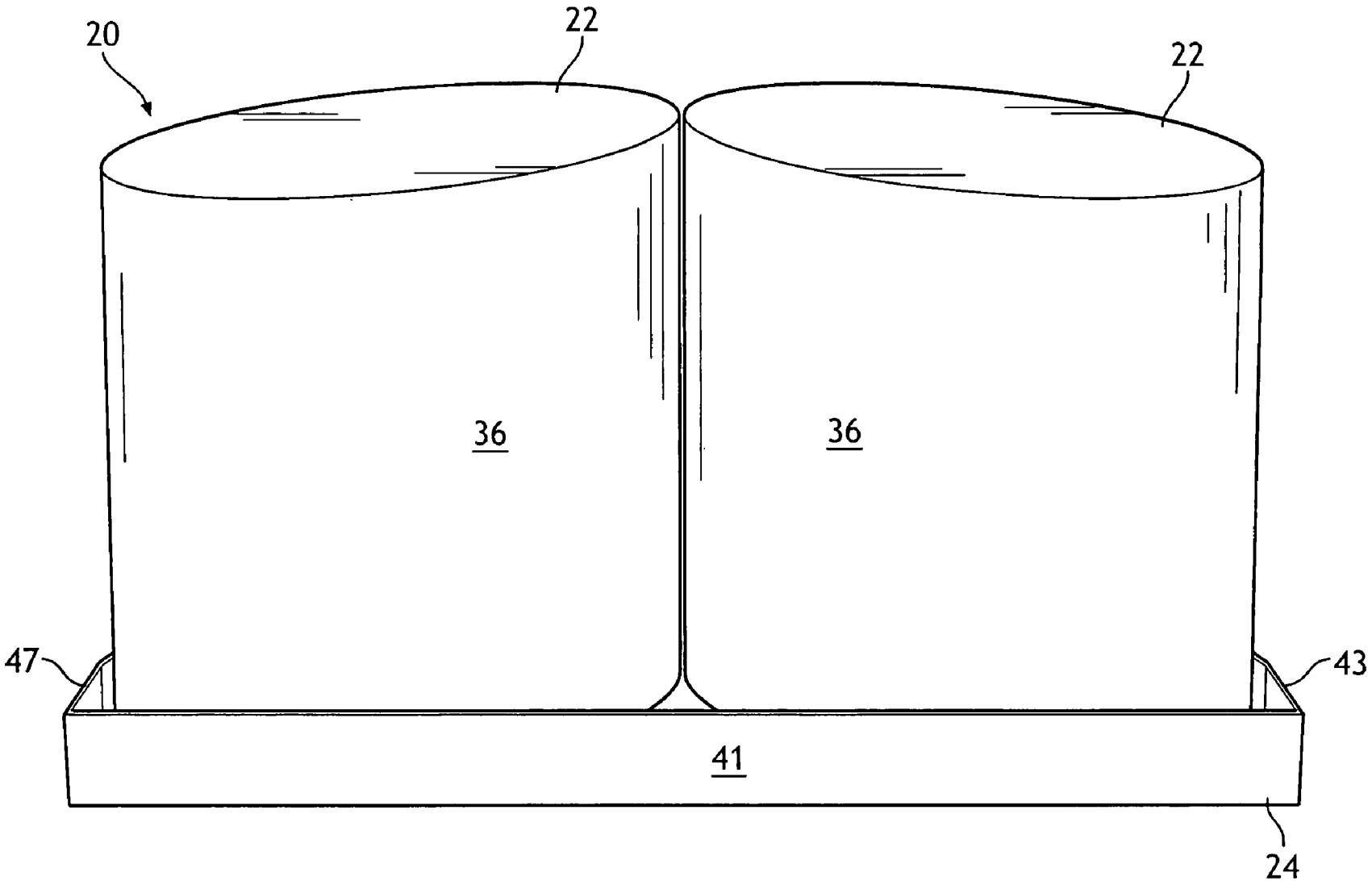
FIG. 6 illustrates a prospective view of a second embodiment of a bundle pack with the packaged products disposed in a tray.
Figure 7:
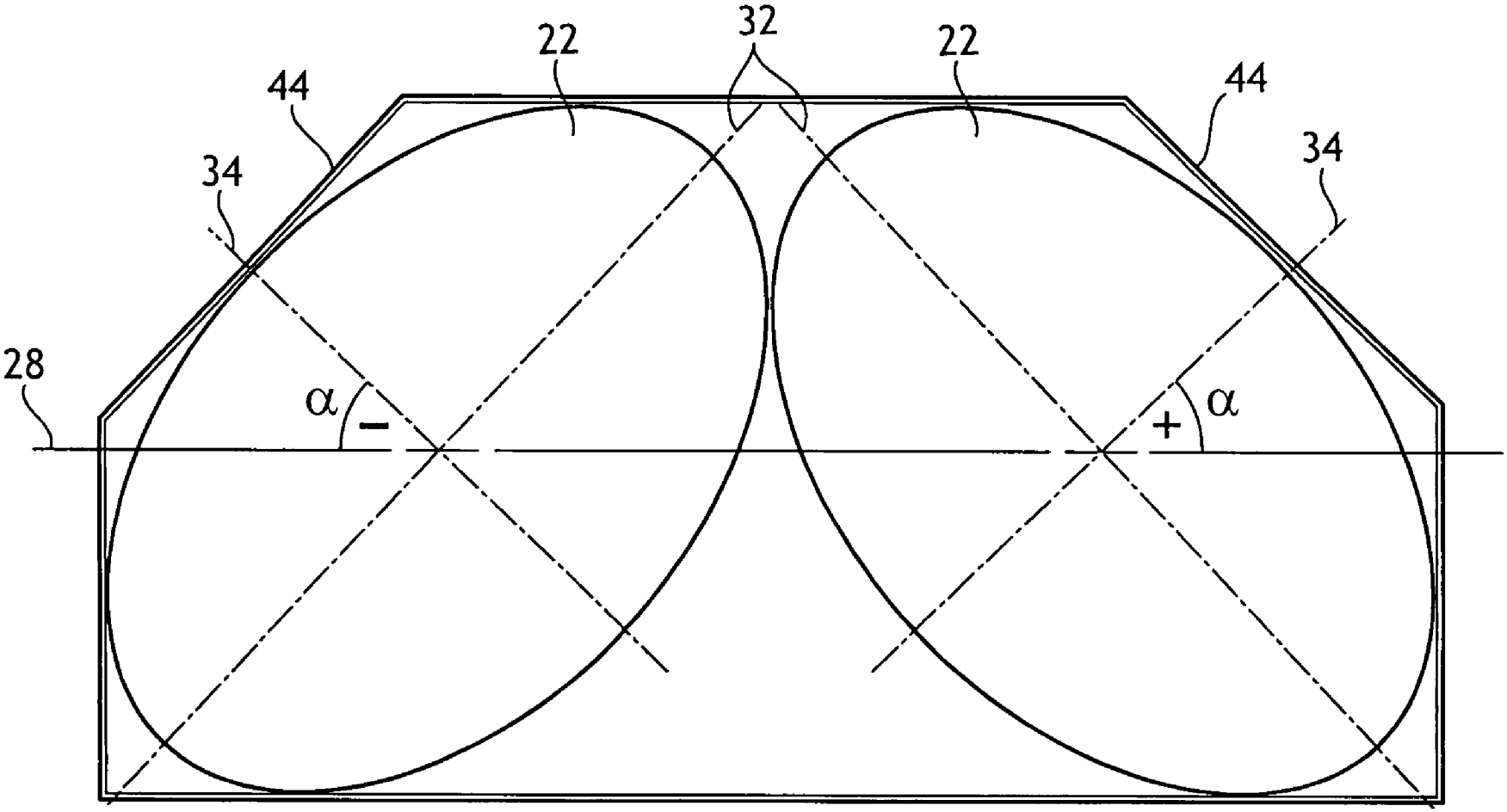
FIG. 7 illustrates a top view of the bundle pack of FIG. 6.
Figure 8:
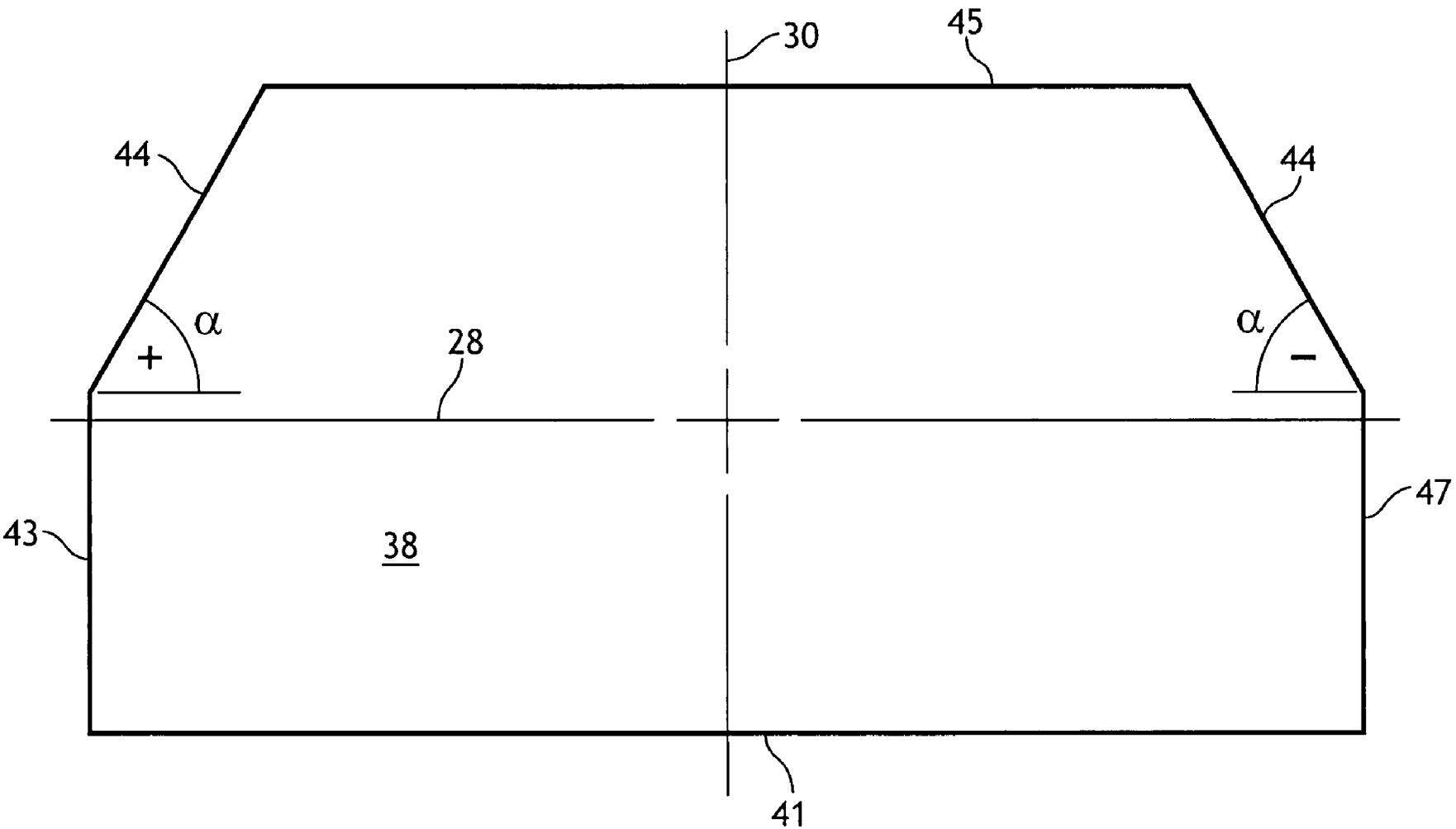
FIG. 8 illustrates a bottom view of the bundle pack of FIG. 6.

Referring now to FIGS. 6, 7, and 8 another embodiment of the bundle pack 20 containing a plurality of packaged products 22 in a tray 24 is shown. As seen, the tray 24 includes two packaged products disposed at a product angle $\alpha$ to the tray longitudinal axis 28. This embodiment differs from the embodiment of FIG. 1 in that the packaged products are disposed at both a positive product angle (right packaged product) and a negative product angle (left packaged product). While only two packaged products are shown, the pattern could be repeated for any number of packaged products.

The tray 24 has a substantially rectangular bottom having two back corners 44 that are angled where the back sidewall 45 meets the right (43) and left (47) side walls. The corners are angled to assist in aligning the packaged products at the negative and positive product angles $\alpha$. As such, the corner angles $\alpha$ can be the same ranges as for the product angle $\alpha$ previously described. Rather than just angle the corner(s) 44, it is possible to angle the entire right and left sidewalls (43, 47) of the tray such that the bottom of the tray is a trapezoid. All of the possible variations as described in relation to the first embodiment can also be embodied into the second embodiment. For example, multiple rows, stacking, different size products, different shaped products, tray dimensions, product angles, and/or corner angles can be varied as previously taught.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A bundle pack comprising:

a tray having a bottom, a sidewall, and a tray longitudinal axis;

a plurality of oval-shaped tissue dispensers disposed in the tray, the oval-shaped tissue dispensers each having a longitudinal axis and a transverse axis;

a shrink wrap covering the tissue dispensers and containing the tissue dispensers in the tray; and wherein the plurality of tissue dispensers are each disposed at an angle in the tray such that each longitudinal axis forms an angle $\alpha$ with the tray longitudinal axis.

2. The bundle pack of claim 1 wherein the angle $\alpha$ for each tissue dispenser is between 10 degrees to about 80 degrees.

3. The bundle pack of claim 1 wherein the angle $\alpha$ for each tissue dispenser is between about 30 degrees to about 60 degrees.

4. The bundle pack of claim 1 wherein the bottom is substantially rectangular in shape having at least one angled corner.

5. The bundle pack of claim 1 wherein the bottom is substantially rectangular in shape having two opposing angled corners.

6. The bundle pack of claim 1 wherein the bundle pack has 180 degree rotational symmetry.

7. The bundle pack of claim 1 wherein the sidewall of the tray has a height from about 0.5 to about 4 inches.

8. The bundle pack of claim 1 wherein the sidewall of the tray has a height from about 1 to about 2 inches.

9. The bundle pack of claim 1 containing 3 oval-shaped facial tissue dispensers.

10. The bundle pack of claim 1 containing 2 oval-shaped facial tissue dispensers, wherein the bottom of the tray is substantially rectangular in shape having two angled back corners.

* * * * *